United States Patent [19]

Hintermeyer

[11] Patent Number: 4,924,527

[45] Date of Patent: May 15, 1990

[54] GARMENT PROTECTOR

[76] Inventor: Marian G. Hintermeyer, 1121 E. Lexington Blvd., Eau Claire, Wis. 54701

[21] Appl. No.: 300,421

[22] Filed: Jan. 23, 1989

[51] Int. Cl.[5] ..... A41D 3/00; A41D 27/00

[52] U.S. Cl. ..... 2/49 R; 2/46; 2/51

[58] Field of Search ..... 2/48, 49 R, 49 A, 50, 2/51, 52, 46

[56] References Cited

U.S. PATENT DOCUMENTS

| | | | |
|---|---|---|---|
| 879,124 | 2/1908 | Thompson | 2/49 R |
| 1,963,130 | 6/1934 | Hall | 2/49 R |
| 2,367,383 | 1/1945 | Tiscornia | 2/49 R |
| 2,404,225 | 7/1946 | Green | 2/48 X |
| 2,504,534 | 4/1950 | Kephart et al. | 2/114 |
| 2,551,907 | 5/1951 | Serebrin | 2/49 R |
| 3,010,111 | 11/1961 | Ralph | 2/49 R |
| 3,540,060 | 11/1970 | Brown | 2/49 |
| 3,916,447 | 11/1975 | Thompson | 2/49 R |
| 3,979,776 | 9/1976 | Gruenwald | 2/49 R |
| 3,995,321 | 12/1976 | Johnson | 2/49 R |
| 4,225,977 | 10/1980 | Smith | 2/48 |
| 4,233,688 | 11/1980 | Hjerl | 2/49 R |
| 4,359,783 | 11/1982 | Andrews | 2/48 |
| 4,423,523 | 1/1984 | Bodner et al. | 2/49 R |
| 4,441,212 | 4/1984 | Ahr et al. | 2/49 R |
| 4,569,086 | 2/1986 | Takefman | 2/49 R |
| 4,620,323 | 11/1986 | Tepper | 2/49 R |
| 4,660,226 | 4/1987 | Quilling et al. | 2/49 R |
| 4,793,004 | 12/1988 | Long et al. | 2/49 R |

*Primary Examiner*—Werner H. Schroeder
*Assistant Examiner*—Jeanette E. Chapman
*Attorney, Agent, or Firm*—Lathrop & Clark

[57] ABSTRACT

A garment protector which may be folded to form a pocket includes a sheet of flexible material which has transverse and oblique folding zones along which the sheet can be folded to form the pocket, and fastening means for maintaining the sheet in its folded condition when it is folded along the folding zones. The sheet includes an upper portion which can be fastened to the neck of an individual, and other portions of the sheet which are defined by the sides and lower end of the sheet, and by the transverse and oblique folding zones. The sheet thus includes a pocket rear wall, a pocket front wall which is foldable over the pocket rear wall, two corner flaps which are foldable upwardly and inwardly over one of the pocket walls, and a lip flap which is foldable over the pocket front wall to form a lip of the pocket.

23 Claims, 3 Drawing Sheets

GARMENT PROTECTOR

BACKGROUND OF THE INVENTION

1. Field of the Invention

The present invention relates to bibs, garment protectors, and aprons, and specifically to such articles which have a pocket.

2. Description of the Related Art

Many different types of bibs, garment protectors, and aprons exist which include pockets for catching the solids and liquids inadvertently dropped by the individual wearing the article. For example. U.S. Pat. No. 4,660,226 to Quilling, et al. discloses a bib removably attached to a user, which has a pocket formed at the bottom of the bib to catch fluids. The sides of the pocket are bonded together with an adhesive. An infant bib which has a detachable substantially rigid trough-shaped collection device fastened by fasteners to the main portion of the bib is disclosed in U.S. Pat. No. 4,569,086 to Takefman. U.S. Pat. No. 2,367,383 to Tiscornia shows a bib formed from a flat sheet blank to include a trough at its bottom end. The ends of the trough have wings with tabs having an adhesive for adhering to the front face of the trough flap. In many of the bibs formed from a single sheet of material, the sides or some other portion of the pocket are held together with an adhesive which also acts as a seal against fluid leakage.

SUMMARY OF THE INVENTION

The present invention is summarized in that a garment protector, which can be used to protect an individual's clothes from liquid and solid materials which are spilled or which can be used to store tools and other items being used, includes a sheet of flexible material with a front surface, a back surface, two sides, a lower end and an upper end; and fastening means for maintaining the sheet in folded condition when the sheet is folded to form a pocket. The sheet includes an upper portion which can be fastened to a neck of an individual, a pocket front wall, a pocket rear wall, two corner flaps, and a lip flap.

The pocket front wall is formed by a first transverse folding zone which extends across the entire sheet, a second transverse folding zone positioned lower on the sheet and extending across the entire sheet substantially parallel to the first transverse folding zone, and two first oblique folding zones which extend, when the sheet is unfolded, at a select angle sidewardly and downwardly on the sheet from the first transverse folding zone to opposite sides of the sheet near the second transverse folding zone.

The pocket rear wall is formed by the first transverse folding zone, an upper margin defined to be positioned above and substantially parallel to the first transverse folding zone and equidistant with the second transverse folding zone from the first transverse folding zone, and two second oblique folding zones which extend at the select angle sidewardly and upwardly on the sheet from the first transverse folding zone to opposite sides of the sheet near the upper margin of the pocket rear wall. The pocket rear wall is connected integrally with the pocket front wall along the first transverse folding zone and with the upper portion of the sheet along the upper margin.

The two corner flaps are each formed by one of the first oblique folding zones, one of the second oblique folding zones, and one side of the sheet. Each corner flap is connected integrally with the pocket front wall along one first oblique folding zone, and with the pocket rear wall along one second oblique folding zone. The first transverse folding zone divides each corner flap into two adjacent corner flap portions. The lip flap extends from the second transverse folding zone to the lower end of the sheet and is integrally connected to the pocket front wall along the second transverse folding zone.

The fastening means maintains the sheet in folded condition when the pocket front wall is folded upwardly against the pocket rear wall along the first transverse folding zone to form a pocket therebetween, the two corner flaps are each folded upwardly and inwardly against one of said walls along the first and second oblique folding zones, and the lip flap is folded against the pocket front wall along the second transverse folding zone.

Each of the oblique folding zones may intersect the first transverse folding zone at one of two points which are lateral of center on the first transverse folding zone. Preferably the select angle of the first and second oblique folding zones with respect to the first transverse folding zone is about 45°.

The fastening means may include a plurality of fasteners which each comprise two fastener parts. At least one fastener could include one wall fastener part positioned just laterally inward of one of the first oblique folding zones near the second transverse folding zone, and another wall fastener part positioned just laterally inward of one of the second oblique folding zones near the pocket rear wall upper margin. Such a fastener will allow the pocket front wall near the second transverse folding zone to be fastened to the pocket rear wall near its upper margin and the side of the sheet. Additionally, at least one fastener may include one corner flap fastener part positioned near where the first transverse folding zone intersects the sides of the sheet, and another corner flap fastener part in substantially mirror-imaged relation thereto across one of the first oblique folding zones on the pocket front wall. This will allow the corner flaps which are folded upwardly and inwardly against the pock®t front Wall to be fastened to the pocket front wall near the second transverse folding zone. Furthermore, one fastener may include a lip flap fastener part positioned on the lip flap, and another lip flap fastener part positioned on the pocket front wall to allow the lip flap to be folded downwardly along the second transverse folding zone and fastened to the pocket front wall.

Although adhesives or other fastening devices could be used to maintain the garment protector in its folded condition, it is not necessary that these fastening devices be used to seal the pocket shut. Nevertheless, the pocket formed by the folded sheet will not have any small openings or areas which might leak which are substantially below the main opening of the pocket, even though the garment protector is formed as a single sheet. The sheet, however, may be formed of several layers of material for additional protection.

A primary object of the invention is to provide a garment protector formed substantially of a sheet of flexible material which may be folded to form a pocket which need not utilize adhesives or fasteners as a sealant against leakage.

Another object of the present invention is to provide a garment protector which can either be left flat without a pocket, or can be folded along transverse and oblique folding zones to form a pocket which, if the material of which the sheet is made is water-proof, will not leak.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENTS

Figure 1:
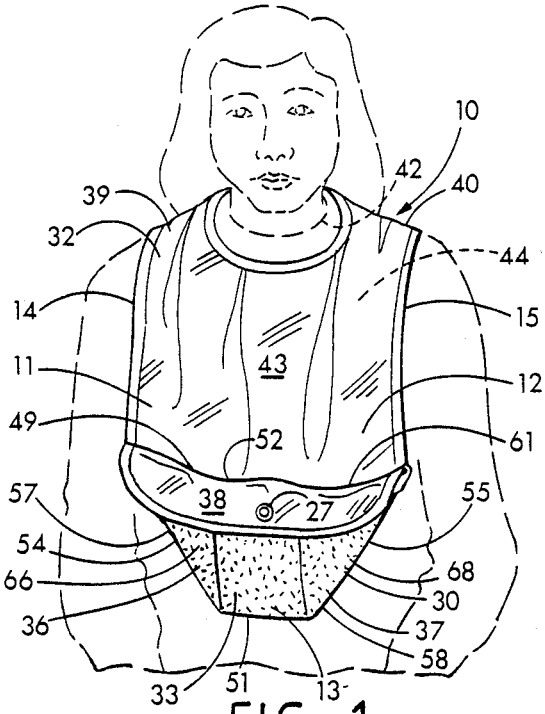
FIG. 1 is a front elevational view of the first preferred garment protector being worn by an individual.

Referring more particularly to the drawings, wherein like numbers refer to similar parts, FIG. 1 shows the preferred garment protector 10 which is used to protect an individual wearing the protector 10 from spills of any materials the individual may drop, such as food. Additionally, the garment protector 10 may serve other useful functions. For example, beauticians might use the garment protector 10 for storing rollers or combs, and assembly workers might use it to carry tools. The garment protector 10 is a bib-like article which is comprised of a sheet 11 of flexible material with a front surface 12, a back surface 13, two sides 14 and 15, a lower end 16 and an upper end 17; and fasteners which as shown are formed of male snap fastener parts 20, 23, and 26, and female snap fastener parts 21, 24, and 27. The pocket 30 shown in FIG. 1 may be formed by folding the sheet 11 progressively as shown in FIGS. 2–6.

Figure 2:
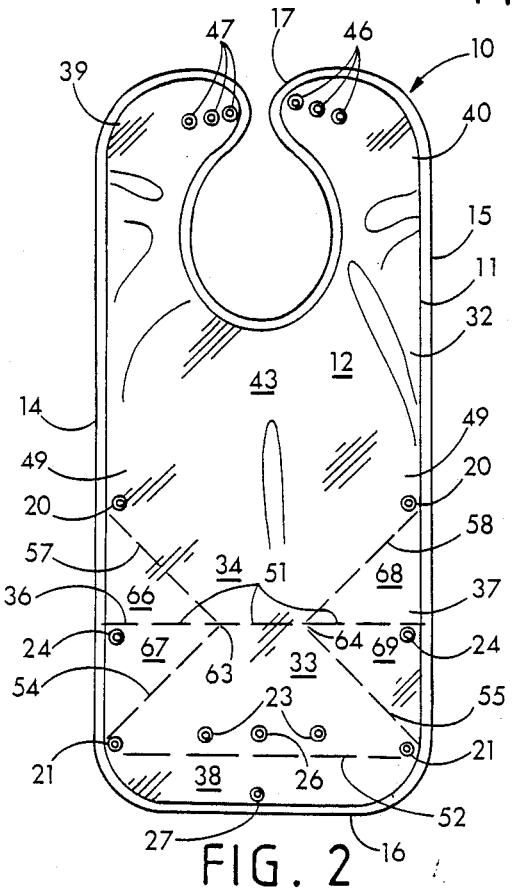
FIG. 2 is a front elevational view of the first preferred garment protector in completely unfolded condition.

As shown in FIG. 2, the sheet 11 includes an upper portion 32, a pocket front wall 33, a pocket rear wall 34, two corner flaps 36 and 37, and a lip flap 38. The upper portion 32 of the sheet 11 includes two neck portions 39 and 40 which are extendable around an individual's neck 42 and a chest portion 43 which is extendable over the chest 44 of the individual. On the neck portions 39 and 40, near the upper end 17 of the sheet 11, are located the male and female parts 46 and 47 of snap fasteners which can interconnect the neck portions 39 and 40 to cause them to be maintained around the neck 42 of the individual. As shown, the plurality of fastener parts 46 and 47 allow the neck portions 39 and 40 to be connected adjustably to allow for different neck 42 sizes. Alternatively the neck portions 39 and 40 might just be tie strings or some other means for maintaining the garment protector on the individual. The chest portion 43 of the sheet 11 extends to and integrally connects with the pocket rear wall 34 along the upper margin 49 of the pocket rear wall 34. Although the garment protector 10 shown in FIGS. 1–6 includes the chest portion 43 for extending over a person's chest 44, alternatively the garment protector could be much shorter, so that the pocket 30 instead overlies the chest 44.

Figure 4:
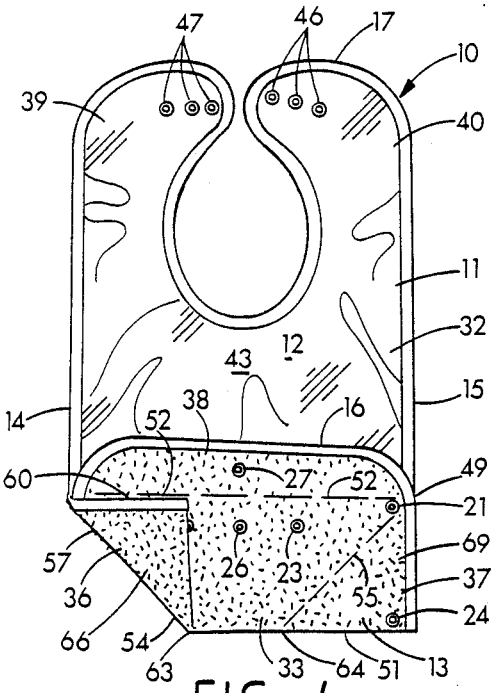
FIG. 4 is a front elevational view of the first preferred garment protector wherein the first pocket front wall is folded to be against the pocket rear wall, and the left corner flap is folded against the pocket front wall.
Figure 5:
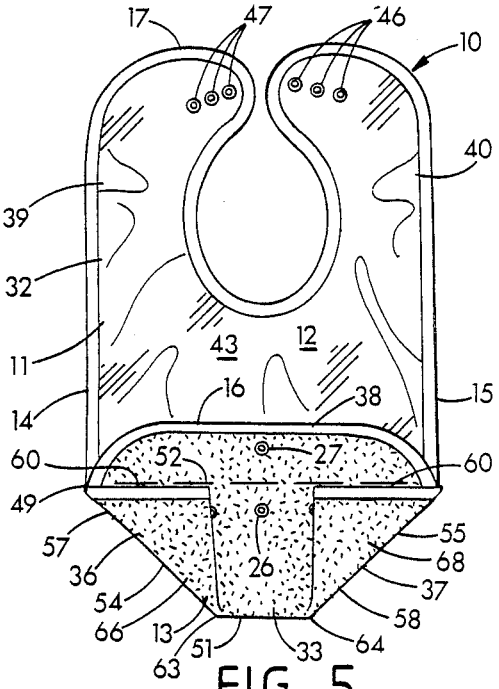
FIG. 5 is a front elevational view of the first preferred garment protector wherein the pocket front wall is folded against the pocket rear wall, and both corner flaps are folded against the pocket front wall.

On the sheet 11 are located several substantially linear folding zones 51, 52, 54, 55, 57, and 58, which when the sheet 11 is folded along these zones, actually form the pocket front wall 33, pocket rear wall 34, corner flaps 36 and 37 and the lip flap 38. Although these folding zones 51, 52, 54, 55, 57, and 58 are not necessarily delineated or shown on the actual sheet 11, the location of the fasteners 20, 21, 23, 24, 26, and 27, and the manner in which the sheet 11 is to be folded inherently limit the positions of the folding zones. The first transverse folding zone 51 extends across the entire sheet 11 at an elevation at which it is desired that the bottom of the pocket 30 be. The second transverse folding zone 52 is positioned lower on the sheet 11 and also extends across the entire sheet 11 substantially parallel to the first transverse folding zone 51. The distance between the first and second transverse folding zones 51 and 52 determines the depth of the pocket 30. This distance also defines the location of the upper margin 49 of the pocket rear wall 34. The width of the sheet 11 at the second transverse folding zone 52 is at least as great as the width of the sheet at the upper margin 49 of the pocket rear wall 34. The upper margin 49 of the pocket rear wall 34 is defined to be a substantially linear zone which is parallel to the first transverse folding zone 52 and which is located above that folding zone 51 at a distance equal to the distance between the first and second transverse folding zones 51 and 52. Two first oblique folding zones 54 and 55 each extend downwardly and outwardly on the unfolded sheet 11 at a select angle of about 45° from the first transverse folding zone 51 to either side 14 or 15 of the sheet 11 near the second transverse folding zone 52. In substantially mirror-imaged relation to the first oblique folding zones 54 and 55 across the first transverse folding zone 51, the two second oblique folding zones extend at a select angle of about 45° sidewardly and upwardly on the sheet 11 from the first transverse folding zone 51 to opposite sides 14 and 15 of the sheet 11 near the upper margin 49 of the pocket rear wall 34. Although the select angle at which the oblique folding zones 54, 55, 57, and 58 extend from the first transverse folding zone 51 is shown to be about 45° in FIGS. 1–6, alternatively some other oblique angle could be chosen which would allow the pocket 30 to be formed without any portion of the pocket 30 opening very far below the upper margin 49 of the pocket rear wall 34. As shown in FIG. 5, the advantage of selecting the 45° angle is that the corner flap openings 60 from which fluids could potentially leak will be substantially at the same level as the upper margin 49 and second transverse folding zone 52, which both define the main pocket opening 61.

Preferably the oblique folding zones 54, 55, 57 and 58 each extend from the first transverse folding zone 51 at one of two points 63 and 64 located laterally of center on the first transverse folding zone 51. Oblique folding zones 54 and 57 or 55 and 58 which extend to the respective sides 14 or 15 of the sheet 11 intersect at the first transverse folding zone 51 at the same point 63 or 64. If the sheet 11 is substantially rectangular in shape, and the select angle of the oblique folding zones is about 45°, the points 63 and 64 will be located on the first transverse folding zone 51 at a distance, from their respective sides 14 or 15 of the sheet 11, which is about equal to the distance between the first and second folding zones 51 and 52. Therefore, if the sheet 11 is quite narrow, or the pocket 30 quite deep, the points 63 and 64 might coincide as a single point at the center of the first transverse folding zone 51. However, normally both points 63 and 64 will be located lateral of the center of the first transverse folding zone 51.

As shown in FIG. 2, the pocket front wall 33 is defined by the first transverse folding zone 51, the first oblique folding zones 54 and 55, and the second transverse folding zone 52. The second transverse folding line 52 also defines the upper margin of the pocket front wall 33. The pocket rear wall 34 is essentially a mirror image of the pocket front wall 33 across the first transverse folding zone 51, and is defined by the first transverse folding zone 51, the second oblique folding zones 57 and 58, and the upper margin 49 of the pocket rear wall 34. The pocket rear wall 34 is connected integrally with the pocket front wall 33 along the first transverse folding zone 51, and with the upper portion 32 of the sheet 11 along its upper margin 49. The lower corners of the folded sheet 11 may be folded to form corner flaps 36, 37.

The corner flap 36 on the left side of FIG. 2 is defined by the side 14 of the sheet 11, the first oblique folding zone 54, and the second oblique folding zone 57. (Left and right are used herein from the viewer's perspective of the figures.) The corner flap 36 is connected integrally to the pocket rear wall 34 along the second oblique folding zone 57, and to the pocket front wall 33 along the first oblique folding zone 54. The corner flap 37 on the right side of FIG. 2 is defined by the side 15 of the sheet 11, the first oblique folding zone 55, and the second oblique folding zone 58. The corner flap 37 is connected integrally to the pocket rear wall 34 along the second oblique folding zone 58, and to the pocket front wall 33 along the first oblique folding zone 55. The first transverse folding zone 51 extends through each of the corner flaps 36 and 37 and divides them substantially into halves, or corner flap portions 66–69. The lip flap 38 is defined by the second transverse folding zone 52, and the sides 14 and 15 and lower end 16 of the sheet 11. The lip flap 38 is connected integrally to the pocket front wall 33 along the second transverse folding zone 52.

Figure 6:
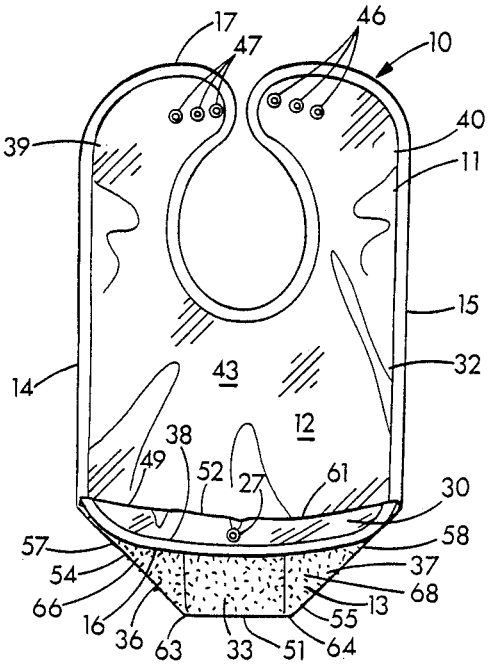
FIG. 6 is a front elevational view of the first preferred garment protector wherein the folding has been completed to form the pocket.
Figure 7:
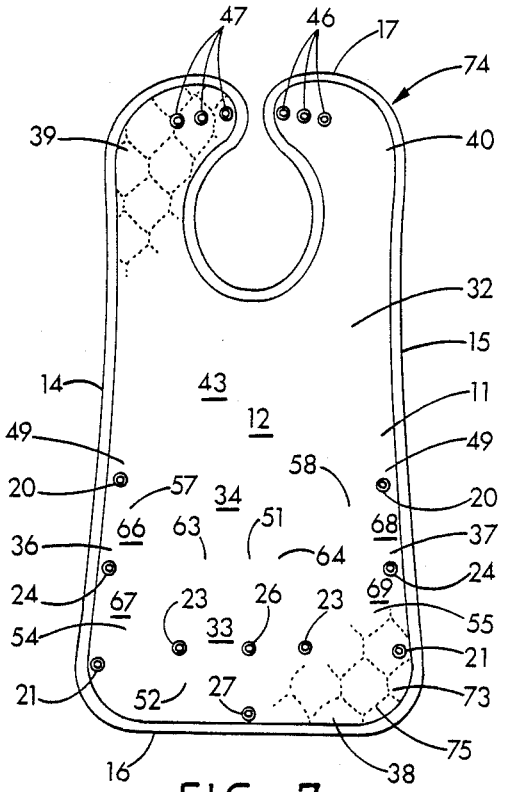
FIG. 7 is a front elevational view of the second preferred garment protector in unfolded condition.

The preferred garment protector 10 shown in FIGS. 1–6 includes several fasteners 20, 21, 23, 24, 26, and 27 which are positioned to provide fastening means for maintaining the sheet 11 in folded condition when the sheet 11 is folded to form the pocket 30. The male and female parts 20 and 21 of the wall snap fasteners are positioned just laterally inward of the oblique folding zones 54, 55, 57, and 58, respectively, near the pocket rear wall upper margin 49 and the second transverse folding zone 52 and near the sides 14 and 15 of the sheet 11. Opposite fastener parts 20 and 21 are positioned in mirror-imaged relationship with respect to the first transverse folding zone 51 so that the pocket front wall 33 can be folded over the pocket rear wall 34 in juxtaposed relation thereto, and the mirror-imaged fastener parts 20 and 21 connected together to maintain the sheet 11 in folded relation along the first transverse folding zone 51 with sides 14 and 15 of the folded sheet 11 each in edge to edge alignment. The sheet 11 is shown folded in this manner in FIG. 3, except that a small corner 71 of the sheet 11 is shown folded slightly forwardly to expose the fastener parts 20 and 21. Alternatively, these fastener parts 20 and 21 might not be in exact mirror-imaged relationship across the first transverse folding zone 51, for example, as shown in FIG. 7.

Figure 3:
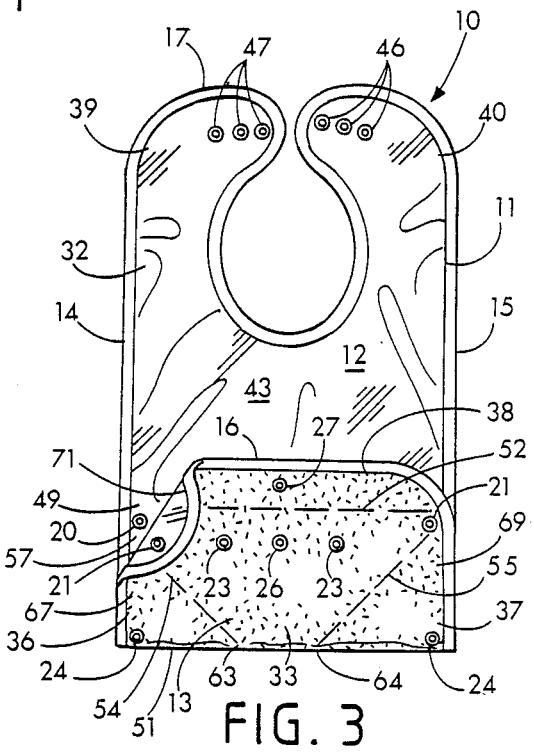
FIG. 3 is a front elevational view of the first preferred garment protector folded along the first transverse folding zone, with a small corner of the garment protector folded forwardly to expose the wall fastener parts.

The preferred garment protector 10 also includes corner flap male and female fastener parts 23 and 24 which are best shown in FIG. 3. The corner flap fastener parts 24 are preferably located on the lower corner flap portions 67 and 69 near where the first transverse folding zone 51 intersects the sides 14 and 15 of the sheet 11. In substantially mirror-imaged relationship, the fastener parts 23 are located across the first oblique folding zones 54 and 55 from the fastener parts 24 on the back surface 13 of the sheet 11 on the pocket front wall 33 near the second transverse folding zone 52. The corner flap fastener parts 24 normally will be positioned lateral of the center of the second transverse folding zone 52. As demonstrated in FIGS. 4–5, the corner flap fastener parts 23 and 24 allow the corner flaps 36 and 37 to be folded upwardly and inwardly against the pocket front wall and fastened thereto near the second transverse folding zone 52. Alternatively, the corner flap fastener parts 23 and 24 could be located so that they could be folded instead over the pocket rear wall 34.

The preferred garment protector 10 also includes lip flap fastener parts 26 and 27 which are positioned on the lip flap 38 and across the second transverse folding zone 52 on the pocket front wall 33. Preferably the lip flap fastener parts 26 and 27 are located centrally between the sides 14 and 15 of the sheet 11. The fastener parts 26 and 27 also could be positioned to allow the pocket 30 to be turned inside out, with the resulting pocket 30 still having the lip flap 38 on the outside.

The pocket 30 of the garment protector 10 is formed preferably by first folding the sheet 11 along the first transverse folding zone 51 as shown in FIG. 3. The front surface of the folded sheet is then over upon itself with the sides of the folded sheet in edge to edge alignment. The wall fastener parts 20 and 21 are then snapped together to maintain the sheet 11 in this folded condition. Next the corner flaps 36 and 37 are folded inwardly and upwardly along the juxtaposed oblique folding zones 54 and 57, and 55 and 58 over the pocket front wall 33 as shown in FIGS. 4 and 5. The corner flap fastener parts 23 and 24 then are snapped together to maintain the corner flaps 36 and 37 in folded position. The folded portions of the sheet 11 will thus retain any foreign material contained in the bottom of the pocket 30. As shown in FIG. 6, the lip flap 38 then is folded downwardly along the second transverse folding zone 52 over the corner flaps 36 and 37 and the pocket front wall 33 to form a waterproof lip for the pocket 30. The lip flap fastener parts 26 and 27 should be snapped together to maintain the lip flap 38 in its folded position. The pocket 30 may be taken apart by performing these steps in reverse order. Since the pocket 30 can be unfolded, it can be more effectively cleaned. There will be no corners into which food could get caught and therefore be difficult to remove.

In the first preferred garment protector 10 shown in FIGS. 1–6, the front surface 12 is formed of a waterproof material while the back surface 13 is formed of an absorbent material such as terry cloth. Alternatively, the sheet 11 could be formed of paper, plastic, or other disposable materials. Materials which also could be used, and which are waterproof and breathable, include Thintech ® fabric which is manufactured by Minnesota Mining & Manufacturing Company, Gor-Tex ® fabric which is manufactured by W. L. Gore & Associates, Inc., and other similar materials. The sheet 11 alternatively might even not be water-proof.

The sheet of which the garment protector is formed could be formed also of two layers 73 of material with padding material therebetween as shown in the second garment protector 74 of FIG. 7. The stitching 75 in the sheet 11 serves to maintain the padding material in place with relationship to the two layers 73 of material. The second preferred garment protector 74 is also different from the first preferred garment protector 10 in that the sides 14 and 15 are beveled outwardly as they approach the lower end 16 of the sheet 11. Otherwise, the second preferred garment protector 74 is fairly similar to the first preferred garment protector 10. The numbers used to designate the parts of the second preferred garment protector 74 therefore are largely the same as those for the first preferred garment protector 11. The pocket 30 is formed in substantially the same way as the pocket 30 for the first preferred garment protector 10. However, in the second preferred garment protector 74, the beveled sides 14 and 15 cause the pocket front wall 33 to be of greater transverse dimension than the pocket rear wall 34. Therefore, when the pocket of the second garment protector 74 is fully constructed, the pocket front wall 33 tends to bulge outwardly from the pocket rear wall 34, thereby causing the pocket 30 to remain fairly widely open. In the second preferred garment protector 74, the pocket front wall 33 and pocket rear wall 34 are not mirror images of each other.

Figure 8:
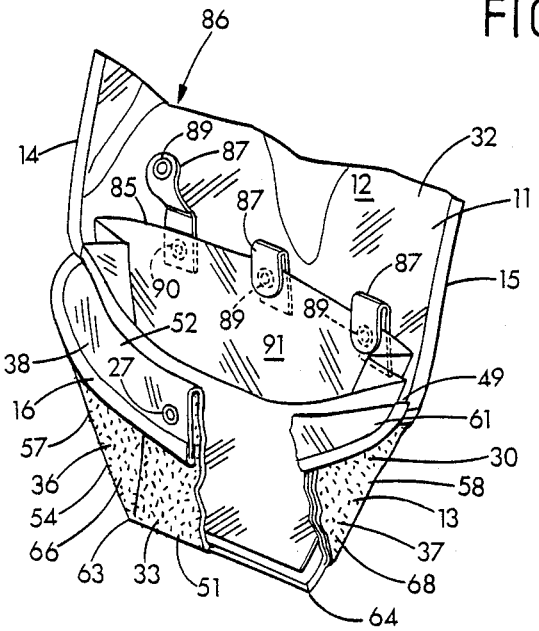
FIG. 8 is a perspective view of a first alternative garment protector with tabs and insert fasteners for maintaining a disposable pocket insert within the pocket.
Figure 9:
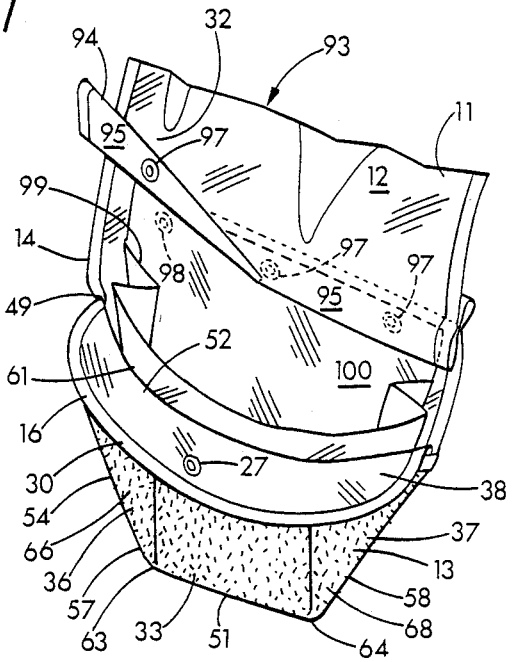
FIG. 9 is a perspective view of a second alternative garment protector with a hem portion and insert fasteners for maintaining a disposable pocket insert within the pocket.

FIGS. 8 and 9 demonstrate that a disposable pocket insert 85 or 99, which is made from some disposable material such as plastic or water-proof paper, may be inserted into the pocket 30 of the garment protector. FIG. 8, which shows a first alterative garment protector 86, demonstrates that the protector 86 also may include tabs 87 which extend out from the sheet 11 above the pocket rear wall 34, and insert fasteners which each include a fastener part 89 on the tab 87 and another fastener part 90 on the sheet 11 below where the tab 87 extends from the sheet 11. Thus when the disposable pocket insert 85 is inserted into the pocket 30, it can be maintained therein by connecting the corresponding fastener parts 89 and 90 on the tabs 87 and sheet 11 with a wall 91 of the disposable pocket insert 85 therebetween.

FIG. 9 shows a second alternative garment protector 93 which includes a hem portion 94 formed of two narrow transverse portions 95 of the sheet 11 which are folded together along substantially horizontal folding zones and which are connected together so that the hem portion 94 extends outwardly from the sheet 11 above the pocket rear wall 34, and insert fasteners which each include a fastener part 97 on the hem portion 94 and another fastener part 98 on the sheet 11 below the hem portion 94. Thus a disposable pocket insert 99 which is inserted into the pocket 30 can be maintained therein by connecting the corresponding fastener parts 97 and 98 on the hem portion 94 and the sheet 11 therebelow with a wall 100 of the disposable pocket insert 99 between the connected fastener parts 97 and 98.

Although the fasteners shown in FIGS. 1–9 are the snap-type of fasteners, alternatively, any of several other various types of fasteners could be used to maintain the sheet 11 in its folded condition. For example, Velcro ® fasteners could be used, or even tape which has adhesive on both sides. With tape which has adhesive on both sides, two-part fasteners would be unnecessary.

The garment protector may be used simply as a bib without the pocket 30, or the pocket 30 could be constructed to catch any fluids, crumbs, or other materials which the individual may spill. Additionally, the garment protector may be used to store tools and other devices and materials which are utilized by the individual wearing the garment protector as he or she works or plays. When constructed properly, the pocket 30 will have no small openings through which material within the pocket can escape below the main opening 61. The construction of the garment protector, especially if it is relatively short, allows an individual the freedom of arm and leg movement.

It is to be understood that the present invention is not limited to the particular arrangement or embodiments of parts disclosed and illustrated herein, nor to the material specified, but embraces all such modified forms thereof as come within the scope of the following claims.

What is claimed is:

1. A garment protector comprising:

(a) a sheet of flexible material with a front surface and a back surface, two sides, a lower end and an upper end;

(b) means for fastening the upper end to a neck of an individual;

(c) a pocket formed by folding the lower end of the sheet upwardly about a first transverse folding zone extending across the sheet from one side to the other so that the front surface of the folded sheet is over upon itself with the sides of the folded sheet in edge to edge alignment and the back surface of the folded lower end of the sheet facing frontwardly to form a pocket front wall with an upper margin and a pocket rear wall with an upper margin, and folding lower corners of the folded sheet upwardly and inwardly about oblique folding zones so that the aligned sides of the folded sheet are extending transversely across and in front of the frontwardly facing back surface of the sheet in substantial alignment and in spaced relation to the bottom of the pocket formed by the folded sheet so that any foreign material contained in the bottom of the pocket will be retained by folded portions of the sheet; and (d) fastening means located near the sides of the sheet near the upper margins of the pocket front and rear walls for connecting the pocket front wall to the pocket rear wall and fastening means located on the folded lower corners for attaching the folded lower corners to the pocket front wall and maintaining the sheet in said folded condition.

2. A garment protector comprising:

(a) a sheet of flexible material with a front surface and a back surface, two sides, a lower end and an upper end;

(b) means for fastening the upper end to a neck of an individual;

(c) a pocket formed by folding the lower end of the sheet upwardly about a first transverse folding zone extending across the sheet form one side to the other so that the front surface of the folded sheet is over upon itself with the sides of the folded sheet in edge to edge alignment and the back surface of the folded lower end of the sheet facing frontwardly to form a pocket front wall and a pocket rear wall with an upper margin, and folding lower corners of the folded sheet upwardly and inwardly about oblique folding zones so that the aligned sides of the folded sheet are extending transversely across and in front of the frontwardly facing back surface of the sheet in substantial alignment and in spaced relation to the bottom of the pocket formed by the folded sheet wherein the pocket is further formed by folding the lower end of the sheet downwardly about a second transverse folding zone which extends across the sheet from one side to the other so that the back surface of the folded sheet is over upon itself, the distance on the front surface of the sheet between the first and second transverse folding zones being the depth of the pocket, wherein the width of the sheet at the second transverse folding zone is at least as great as the width of the sheet at the upper margin of the pocket rear wall; and (d) fastening means for maintaining the sheet in said folded condition.

3. The garment protector specified in claim 1 wherein the select angle of the first and second oblique folding zones with respect to the first transverse folding zone is about 45°.

4. The garment protector specified in claim 1 wherein the fastening means includes a plurality of fasteners which each comprise two fastener parts.

5. The garment protector specified in claim 4 wherein the fasteners for maintaining the lower end of the sheet folded upwardly about the first transverse folding zone are located near the edges of the sheet and are spaced from the first transverse folding zone a selected distance which substantially defines the depth of the pocket.

6. A garment protector comprising:

(a) a sheet of flexible material with a front surface and a back surface, two sides, a lower end and an upper end;

(b) means for fastening the upper end to a neck of an individual;

(c) a pocket formed by folding the lower end of the sheet upwardly about a first transverse folding zone extending across the sheet form one side to the other so that the front surface of the folded sheet is over upon itself with the sides of the folded sheet in edge to edge alignment and the back surface of the folded lower end of the sheet facing frontwardly, and folding lower corners of the folded sheet upwardly and inwardly about oblique folding zones so that the aligned sides of the folded sheet are extending transversely across and in front of the frontwardly facing back surface of the sheet in substantial alignment and in spaced relation to the bottom of the pocket formed by the folded sheet so that any foreign material contained in the bottom of the pocket will be retained by folded portions of the sheet; and (d) wherein the pocket is further formed by folding the lower end of the sheet downwardly about a second transverse folding zone which extends across the sheet from one side to the other so that the back surface of the folded sheet is over upon itself, the distance on the front surface of the sheet between the first and second transverse folding zones being the depth of the pocket; and (e) a plurality of fasteners for maintaining the sheet in the folded condition which each comprise two parts, wherein each fastener includes one part on a portion of the back surface which is folded over upon itself about the second transverse folding zone and the other part is located on the forwardly facing back surface to engage the one part and retain the sheet folded about the second transverse folding zone.

7. The garment protector specified in claim 6 wherein two fastener parts are positioned on the frontwardly facing back surface, each spaced from the intersection of the first transverse folding zone with a side of the sheet, and wherein each said fastener part is adapted to engage another fastener part located on the frontwardly facing back surface when the lower corners are folded about the first oblique folding zones.

8. A garment protector comprising:

(a) a sheet of flexible material with a front surface and a back surface, two sides, a lower end and an upper end;

(b) means for fastening the upper end to a neck of an individual;

(c) a pocket formed by folding the lower end of the sheet upwardly about a first transverse folding zone extending across the sheet from one side to the other so that the front surface of the folded sheet is over upon itself with the sides of the folded sheet in edge to edge alignment and the back surface of the folded lower end of the sheet facing frontwardly, and folding lower corners of the folded sheet upwardly and inwardly about oblique folding zones so that the aligned sides of the folded sheet are extending transversely across and in front of the frontwardly facing back surface of the sheet in substantial alignment and in spaced relation to the bottom of the pocket formed by the folded sheet so that any foreign material contained in the bottom of the pocket will be retained by folded portions of the sheet;

(d) a disposable pocket insert which is insertable into the pocket;

(e) a hem portion formed of two narrow transverse portions of the sheet which are folded together along substantially horizontal folding zones and which are connected together so that the hem portion extends outwardly from the sheet above the pocket;

(f) insert fasteners which each include a fastener part on the hem portion and another fastener part on the sheet inwardly of the hem portion, so that the disposable pocket insert which is inserted into the pocket can be maintained therein by connecting the corresponding fastener parts on the hem portion and the sheet with a wall of the disposable pocket insert between the connected fastener parts.

9. A garment protector comprising:

(a) a sheet of flexible material with a front surface, a back surface, two sides, a lower end and an upper end, said sheet including (1) an upper portion which can be fastened to a neck of an individual;

(2) a pocket front wall formed by a first transverse folding zone which extends across the entire sheet, a second transverse folding zone positioned lower on the sheet and extending across the entire sheet substantially parallel to the first transverse folding zone, and two first oblique folding zones which extend, when the sheet is unfolded, at a select angle sidewardly and downwardly on the sheet from the first transverse folding zone to opposite sides of the sheet near the second transverse folding zone;

(3) a pocket rear wall formed by the first transverse folding zone, an upper margin defined to be positioned above and substantially parallel to the first transverse folding zone and equidistant with the second transverse folding zone from the first transverse folding zone, and two second oblique folding zones which extend at the select angle sidewardly and upwardly on the sheet from the first transverse folding zone to opposite sides of the sheet near the upper margin of the pocket rear wall, the pocket rear wall being connected integrally with the pocket front wall along the first transverse folding zone and with the upper portion of the sheet along the upper margin;

(4) two corner flaps, each formed by one first oblique folding zone, one second oblique folding zone, and one side of the sheet, and being connected integrally with the pocket front wall along the first oblique folding zone and with the pocket rear wall along the second oblique folding zone, the first transverse folding zone dividing each corner flap into two adjacent corner flap portions; and (5) a lip flap which extends from the second transverse folding zone to the lower end of the sheet and which is integrally connected with the pocket front wall along the second transverse folding zone; and (b) fastening means for maintaining the sheet in folded condition when the pocket front wall is folded upwardly against the pocket rear wall along the first transverse folding zone to form a pocket therebetween, the two corner flaps are each folded upwardly and inwardly against one of said walls along the first and second oblique folding zones, and the lip flap is folded against the pocket front wall along the second transverse folding zone.

10. The garment protector specified in claim 9 wherein each of the oblique folding zones intersect the first transverse folding zone at one of two points lateral center on the first transverse folding zone.

11. The garment protector specified in claim 9 wherein the select angle of the first and second oblique folding zones with respect to the first transverse folding zone is about 45°.

12. The garment protector specified in claim 9 wherein the fastening means includes a plurality of fasteners which each comprise two fastener parts.

13. The garment protector specified in claim 12 wherein at least one fastener includes one fastener part positioned just laterally inward of one of the first oblique folding zones near the second transverse folding zone, and another fastener part positioned just laterally inward of one of the second oblique folding zones near the pocket rear wall upper margin to allow the pocket front wall near the second transverse folding zone to be fastened to the pocket rear wall near its upper margin and the side of the sheet.

14. The garment protector specified in claim 12 wherein at least one fastener includes one corner flap fastener part positioned near where the first transverse folding zone intersects the sides of the sheet, and another corner flap fastener part in substantially mirror-imaged relation thereto across one of the first oblique folding zones on the pocket front wall, to allow the corner flaps which are folded upwardly and inwardly against the pocket front wall to be fastened to the pocket front wall near the second transverse folding zone.

15. The garment protector specified in claim 9 wherein the sheet upper portion includes neck portions for extending around the individual's neck; and neck portion fasteners which can interconnect the neck portions to cause the neck portions to encircle and be maintained around a neck of the individual.

16. The garment protector specified in claim 9 wherein the upper portion of the sheet includes a chest portion for extending over a chest of the individual, and which extends to and integrally connects to the pocket rear wall along the upper margin of the pocket rear wall.

17. The garment protector specified in claim 9 further including at least one tab which extends out from the sheet above the pocket rear wall; and insert fasteners which each include a fastener part on the tab and another fastener part on the sheet below where the tab extends from the sheet, so that a disposable pocket insert which is inserted into the pocket can be maintained therein by connecting the corresponding fastener parts on the tabs and sheet with a wall of the disposable pocket insert between the connected fastener parts.

18. The garment protector specified in claim 9 further including a hem portion formed of two narrow transverse portions of the sheet which are folded together along substantially horizontal folding zones and which are connected together so that the hem portion extends outwardly from the sheet above the pocket rear wall; and insert fasteners which each include a fastener part on the hem portion and another fastener part on the sheet below the hem portion, so that a disposable pocket insert which is inserted into the pocket can be maintained therein by connecting the corresponding fastener parts on the hem portion and sheet therebelow with a wall of the disposable pocket insert between the connected fastener parts.

19. The garment protector specified in claim 9 wherein at least one of the surfaces of the sheet is water proof.

20. The garment protector specified in claim 9 wherein at least one of the surfaces of the sheet is formed of terry cloth.

21. The garment protector specified in claim 9 wherein the sheet is formed of two layers of material with a padding material therebetween.

22. The garment protector specified in claim 9 wherein the sides of the sheet as they approach the lower end of the sheet are positioned further apart so that the pocket front wall when fastened to the pocket rear wall tends to bulge outwardly form the pocket rear wall more than it otherwise would.

23. A garment protector comprising:

(a) a sheet of flexible material with a front surface, a back surface, two sides, a lower end and an upper end, said sheet including (1) an upper portion which can be fastened to a neck of an individual;

(2) a pocket front wall formed by a first transverse folding zone which extends across the entire sheet, a second transverse folding zone positioned lower on the sheet and extending across the entire sheet substantially parallel to the first transverse folding zone, and two first oblique folding zones which extend, when the sheet is unfolded, at a select angle sidewardly and downwardly on the sheet from the first transverse folding zone to opposite sides of the sheet near the second transverse folding zone;

(3) a pocket rear wall formed by the first transverse folding zone, an upper margin defined to be positioned above and substantially parallel to the first transverse folding zone and equidistant with the second transverse folding zone from the first transverse folding zone, and two second oblique folding zones which extend at the select angle sidewardly and upwardly on the sheet from the first transverse folding zone to opposite sides of the sheet near the upper margin of the pocket rear wall, the pocket rear wall being connected integrally with the pocket front wall along the first transverse folding zone and with the upper portion of the sheet along the upper margin;

(4) two corner flaps, each formed by one first oblique folding zone, one second oblique folding zone, and one side of the sheet, and being connected integrally with the pocket front wall along the first oblique folding zone and with the pocket rear wall along the second oblique folding zone, the first transverse folding zone dividing each corner flap into two adjacent corner flap portions; and (5) a lip flap which extends from the second transverse folding zone to the lower end of the sheet and which is integrally connected with the pocket front wall along the second transverse folding zone; and (b) at least one wall fastener including one wall fastener part positioned just laterally inward of one of the first oblique folding zones near the second transverse folding zone, and another wall fastener part positioned just laterally inward of one of the second oblique folding zones near the pocket rear wall upper margin to allow the pocket front wall near the second transverse folding zone to be fastened to the pocket rear wall near its upper margin and the side of the sheet;

(c) at least one corner flap fastener including one corner flap fastener part positioned near where the first transverse folding zone intersects the sides of the sheet, and another corner flap fastener part in substantially mirror-imaged relation thereto across one of the first oblique folding zones on the pocket front wall, to allow the corner flaps which are folded upwardly and inwardly against the pocket front wall to be fastened to the pocket front wall near the second transverse folding zone; and (d) a lip flap fastener including one lip flap fastener part positioned on the lip flap, and another lip flap fastener part positioned on the pocket front wall to allow the lip flap to be folded downwardly along the second transverse folding zone and fastened to the pocket front wall.

* * * * *